US006371897B1

(12) United States Patent
Huang

(10) Patent No.: US 6,371,897 B1
(45) Date of Patent: Apr. 16, 2002

(54) BOTH FEET-USED ARCH SWINGING EXERCISER

(76) Inventor: Shun-Tsai Huang, No. 1, Lane 160, Sec. 2 Tan-Fu Road, Tan-Tze Hsiang, Taichung Hsien (TW)

( * ) Notice: Subject to any disclaimer, the term of this patent is extended or adjusted under 35 U.S.C. 154(b) by 47 days.

(21) Appl. No.: 09/725,222

(22) Filed: Nov. 29, 2000

(51) Int. Cl.[7] ..... A61H 1/02; A61H 7/00; A61H 1/00

(52) U.S. Cl. ..... 482/148; 601/98; 601/92; 601/89

(58) Field of Search ..... 601/98, 89, 87, 601/101, 35, 92, 93, 84–86, 94–97, 99–104, 29, 26; 482/148, 51, 79, 80

(56) References Cited

U.S. PATENT DOCUMENTS 5,328,443 A * 7/1994 Lee ..... 601/92
5,411,469 A * 5/1995 Wang ..... 601/92
5,417,644 A * 5/1995 Lee ..... 601/98
6,056,706 A * 5/2000 Hung ..... 601/89

* cited by examiner

*Primary Examiner*—Stephen R. Crow
(74) *Attorney, Agent, or Firm*—Rosenberg, Klein & Lee

(57) ABSTRACT

Both feet-used arch swinging exerciser includes a hollow housing, a driving unit and an arch swinging mechanism. The driving has a rotary output shaft on which a rotary block is disposed. A driving rod extends from the rotary block. The arch swinging mechanism includes an arch swinging member and an extension rack for resting both feet of a user. The arch swinging exerciser is swung through a unique arch swinging path so that the arch swinging exerciser not only can horizontally swing and exercise both feet, but also can intermittently vertically exercise both feet. Therefore, the feet are more smoothly exercised to eliminate the tiredness of the feet and expedite blood circulation of the feet, legs and waist of the user. In addition, the safety in use of the arch swinging exerciser can be ensured.

3 Claims, 8 Drawing Sheets

BOTH FEET-USED ARCH SWINGING EXERCISER

BACKGROUND OF THE INVENTION

The present invention is related to a both feet-used arch swinging exerciser, and more particularly to a swinging exerciser swingable through a unique arch swinging path so that the arch swinging exerciser not only can horizontally swing and exercise both feet, but also can intermittently vertically exercise both feet. Therefore, the feet are more smoothly exercised to eliminate the tiredness of the feet and expedite blood circulation of the feet, legs and waist of the user. In addition, the safety in use of the arch swinging exerciser can be ensured.

FIGS. 1 to 3 shows a conventional both feet-used swinging exerciser which is horizontally reciprocally movable. Such exerciser includes:

- a hollow housing 910 having a bottom board 911 and a casing 912 defining a receiving space;
- a driving unit 920 fixed on the bottom board 911 and having a rotary output shaft 921, a circular rotary block 922 being disposed on the output shaft 921, a driving rod 923 extending from the rotary block 922 in parallel to the output shaft 921 and being spaced from the output shaft 921 by a certain distance d; and
- a horizontally swinging mechanism 80 including two horizontal slide rods 81 fixed on the bottom board 911, a horizontally movable block 82 and an extension rack 83 on which both feet are rested. The movable block 82 is formed with a central longitudinal slot 821 cooperating with the driving rod 923.

Please refer to FIGS. 4A to 4D which show the operation of the conventional swinging exerciser. The four figures respectively show the states that the driving rod 923 is rotated to an uppermost position, a leftmost position, a lowest position and a rightmost position. However, no matter where the driving rod 923 is positioned, the extension rack 83 of the horizontally swinging mechanism 80 can be only horizontally moved. That is, both feet of a user can be only horizontally moved and exercised left and right.

Moreover, it is known that the length from the heels of both legs to the hip of a user is the same. Therefore, when the extension rack 83 is horizontally outward moved to the outermost position, the heel of the outward foot will be forcedly pulled by the extension rack 83 outward by a certain distance. Accordingly, in case that the swinging exerciser is improperly used, (for example, the swinging exerciser swings at too fast speed) or the user has poor body property (such as an old man suffering osteoporosis), the lumber bones of the user may get injured. Therefore, the safety in use of the conventional swinging exerciser cannot be ensured.

SUMMARY OF THE INVENTION

It is therefore a primary object of the present invention to provide a both feet-used arch swinging exerciser which not only can horizontally swing and exercise both feet of a user, but also can intermittently vertically exercise both feet.

It is a further object of the present invention to provide the above swinging exerciser by which the feet of the user are more smoothly exercised through an arch path without being pulled outward by a small distance. Therefore, the lumber bones of the user are protected from being injured and the safety in use of the swinging exerciser can be ensured.

It is still a further object of the present invention to provide the above swinging exerciser which is able to eliminate the tiredness of the feet and expedite blood circulation of the feet, legs and waist of the user.

The present invention can be best understood through the following description and accompanying drawings wherein:

DETAILED DESCRIPTION OF THE PREFERRED EMBODIMENT

Figure 1:
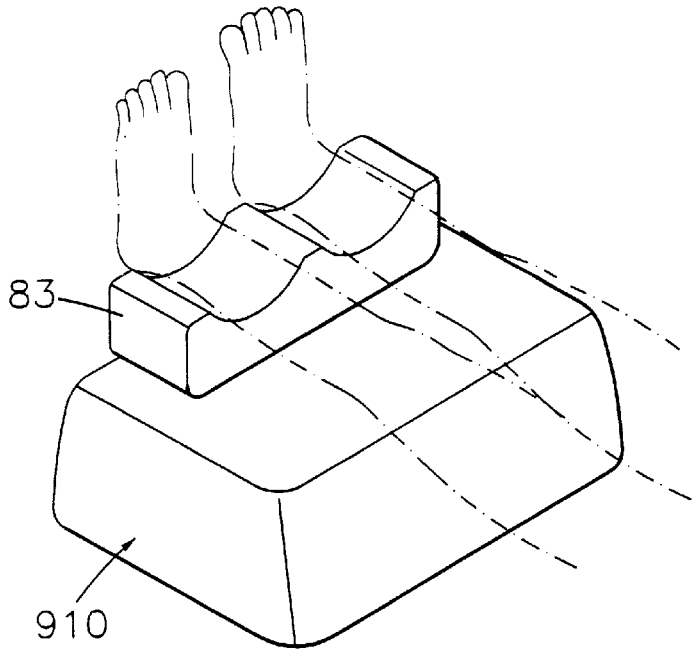
FIG. 1 (PRIOR ART)
FIG. 1 is a perspective view of a conventional both feet-used horizontally swinging exerciser.
Figure 2:
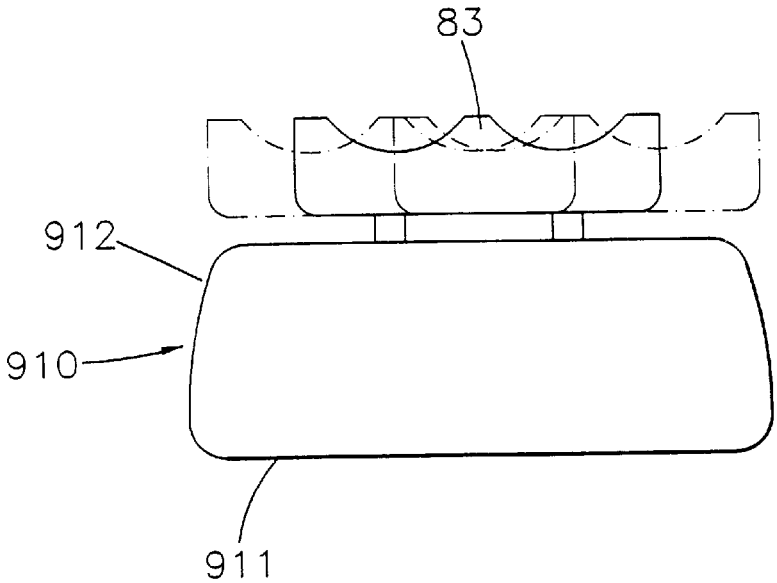
FIG. 2 (PRIOR ART)
FIG. 2 is a front view of the conventional both feet-used horizontally swinging exerciser.
Figure 3:
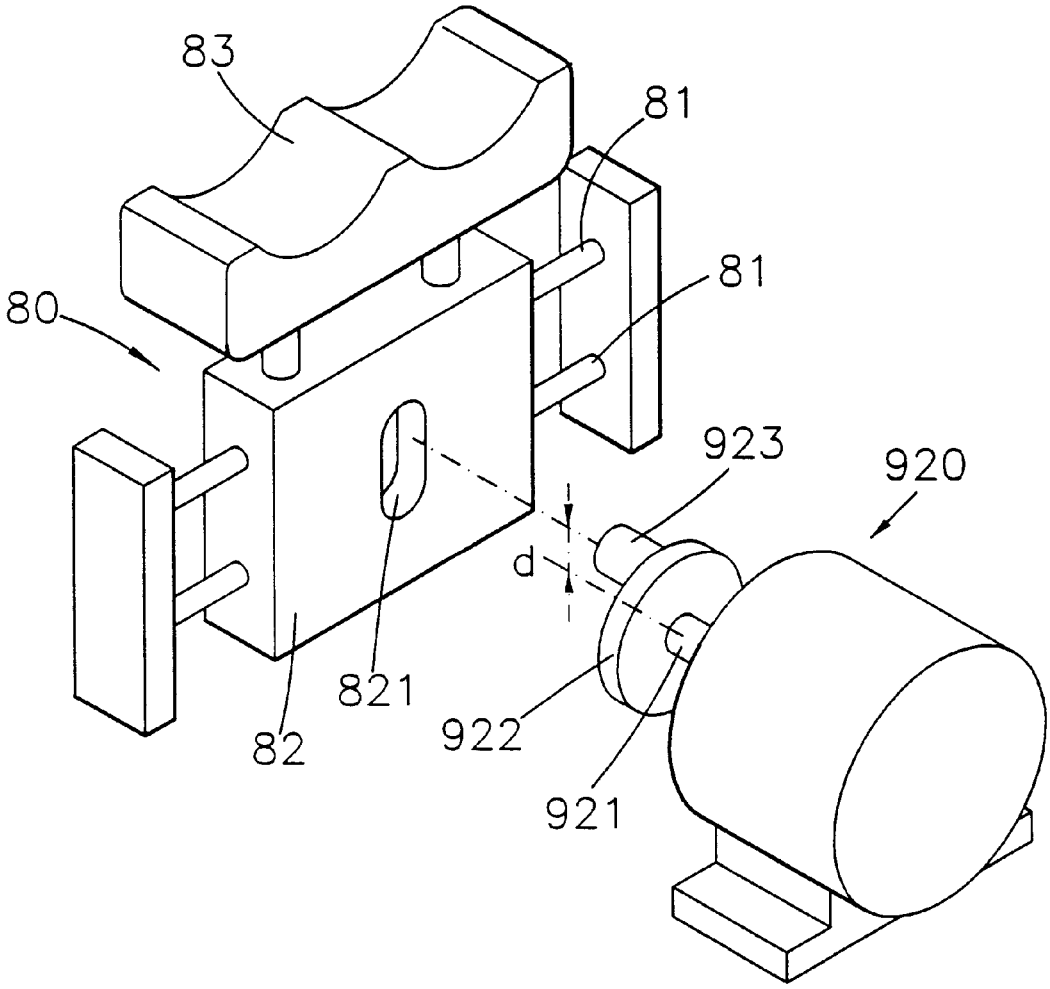
FIG. 3 (PRIOR ART)
FIG. 3 is a perspective exploded view of the conventional both feet-used horizontally swinging exerciser.
Figure 4A:
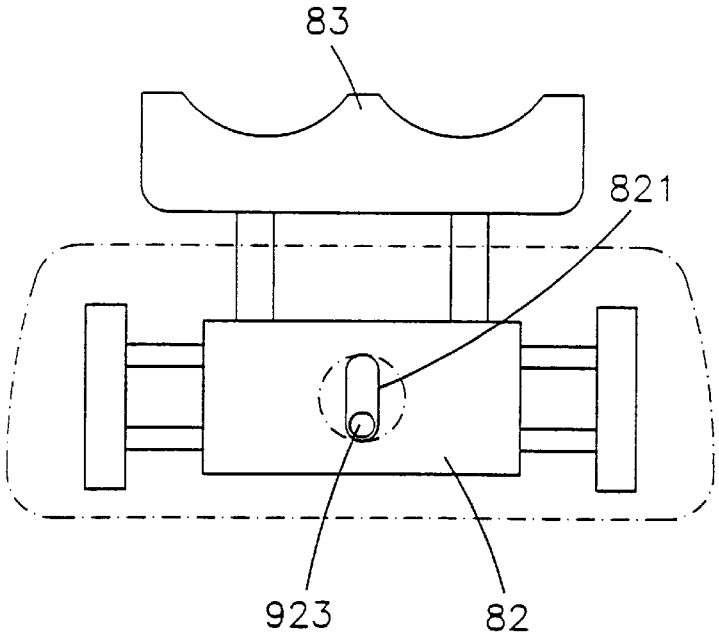
FIG. 4A (PRIOR ART)
FIGS. 4A, 4B, 4C and 4D are front views of the conventional both feet-used horizontally swinging exerciser, respectively showing the states that the driving rod thereof is rotated to an uppermost position, a leftmost position, a lowest position and a rightmost position.
Figure 4B:
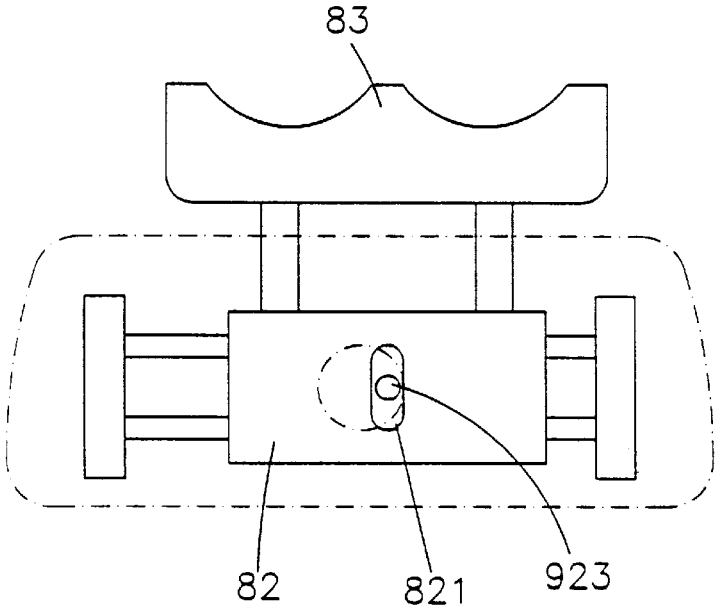
FIG. 4B (PRIOR ART)
Figure 4C:
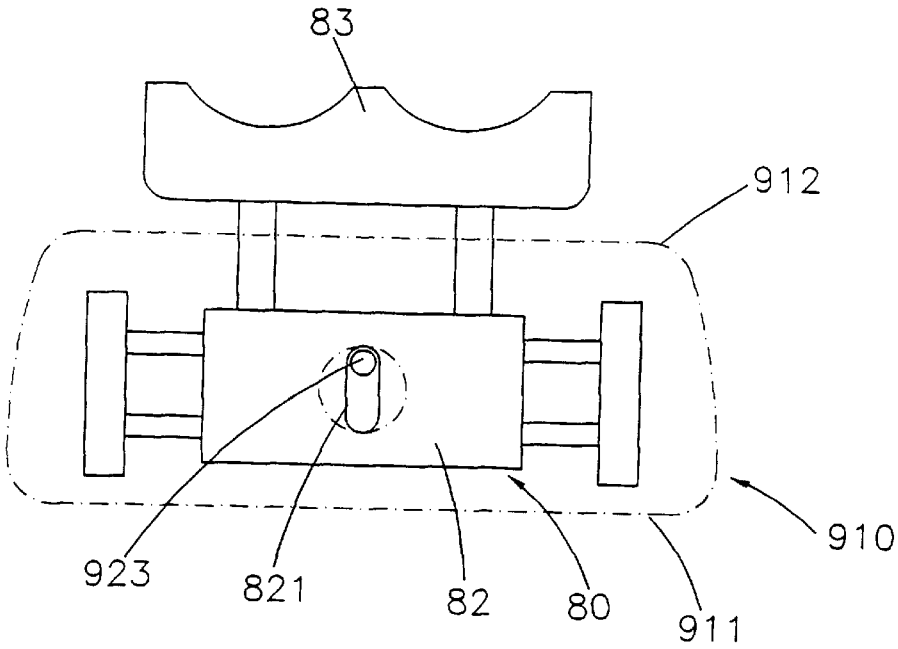
FIG. 4C (PRIOR ART)
Figure 4D:
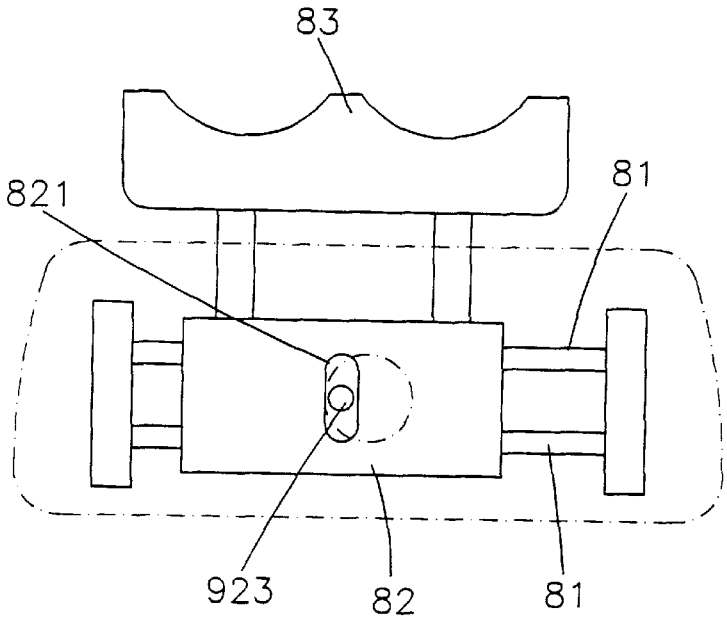
FIG. 4D (PRIOR ART)
Figure 5:
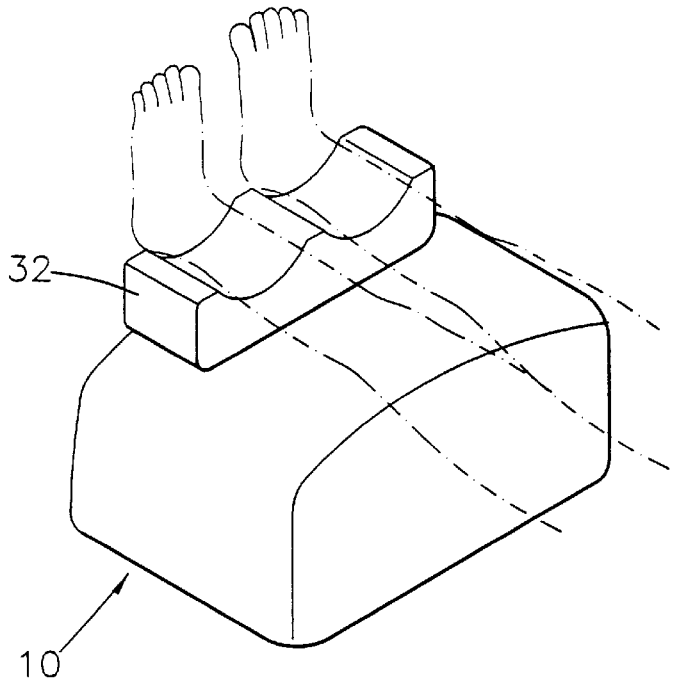
FIG. 5 is a perspective view of the present invention.
Figure 6:
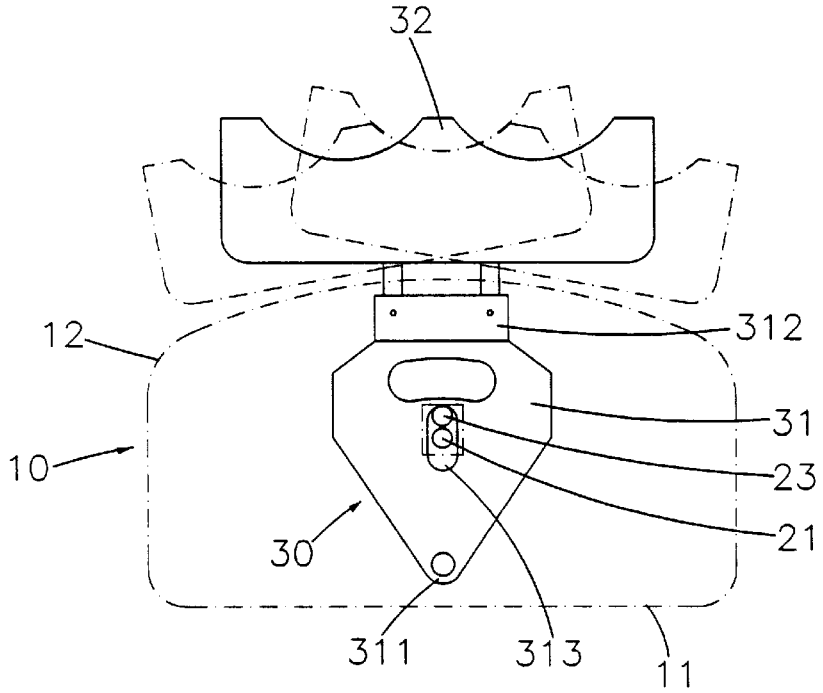
FIG. 6 is a perspective view of the present invention, showing the arch swinging path thereof.
Figure 7:
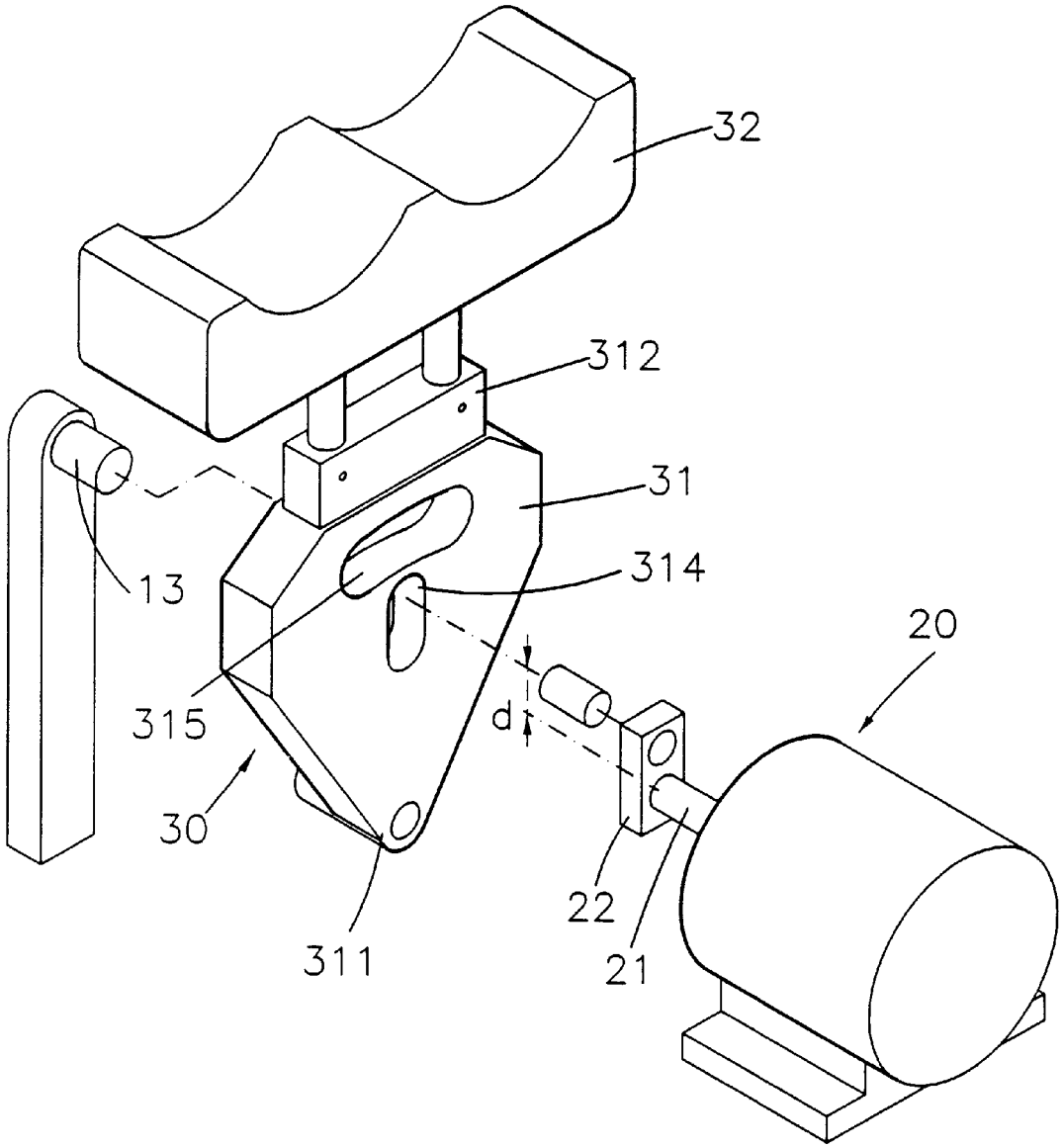
FIG. 7 is a perspective exploded view of the present invention.

Please refer to FIGS. 5 to 7. The both feet-used swinging exerciser of the present invention includes a hollow housing 10, a driving unit 20 and an arch swinging mechanism 30.

The housing 10 includes a bottom board 11 and a casing 12 defining a receiving space therebetween.

The driving unit 20 is fixed on the bottom board 11 and has a rotary output shaft 21. A rotary block 22 is disposed on the output shaft 21. A driving rod 23 extends from the rotary block 22 in parallel to the output shaft 21 and is spaced from the output shaft 21 by a certain distance d.

The arch swinging mechanism 30 includes an arch swinging member 31 and an extension rack 32. The extension rack 32 is positioned outside the housing 10 for both feet of a user to rest thereon. The arch swinging member 31 has a bottom end 311, a top end 312 and a central driven slot 313. The bottom end 311 is pivotally connected with the bottom board 11. The top end 312 is fixedly connected with the extension rack 32. The driving rod 23 extends into the driven slot 313 and cooperates therewith. When the driving rod 23 is operated through a circular path, the arch swinging mechanism 30 is reciprocally swung through an arch path.

In more details, the swinging amplitude of the arch swinging mechanism is preferably within 120 degrees. The length of the driven slot 313 is preferably approximately twice the distance d. In addition, the width of the driven slot 313 is about equal to the outer diameter of the driving rod.

In order to enhance the stability of the arch swinging mechanism 31, an arch guide slot 315 is further formed on the swinging member. An auxiliary supporting member 13 fixed on the bottom board 11 is inserted into the arch guide slot 315 for auxiliarily supporting the arch swinging mechanism 31. Accordingly, the weight of both feet is partially borne by the auxiliary supporting member 13 so as to prolong using life of the swinging exerciser.

Please refer to FIGS. 8A to 8D which show the operation of the present invention. First, in FIG. 8A, the driving shaft

23 of the rotary block 22 is positioned at the highest point of the circular moving path. In addition, it is assumed that the left and right feet of a user be respectively rested on the left and right arch recesses of the extension rack 32.

Figure 8A:
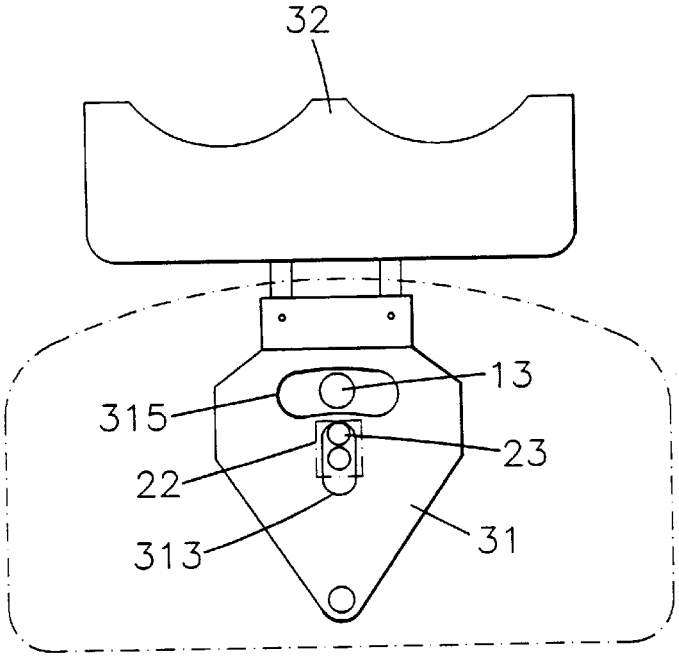
FIGS. 8A, 8B, 8C and 8D are front views of the present invention, respectively showing the operation thereof in different states.
Figure 8B:
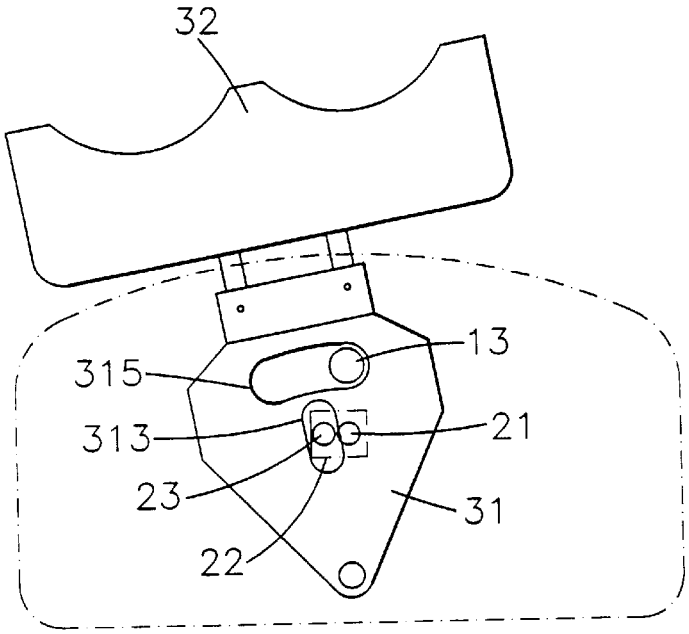

When the rotary block 23 is counterclockwise rotated by 90 degrees as shown in FIG. 8B, the driving shaft 23 of the rotary block 22 is moved to the leftmost point of the circular moving path. At this time, the central driven slot 313 is forced to tilt leftward. That is, the extension rack 32 of the arch swinging mechanism 30 is moved leftward and tilted through an arch path. Accordingly, the left foot of the user is positioned on a level lower than that of the right foot. The left foot is moved downward so that no matter whether the user's body is sitting or lying, the part of the user's body from the lumber bones to the left and right feet can be more smoothly exercised.

Figure 8C:
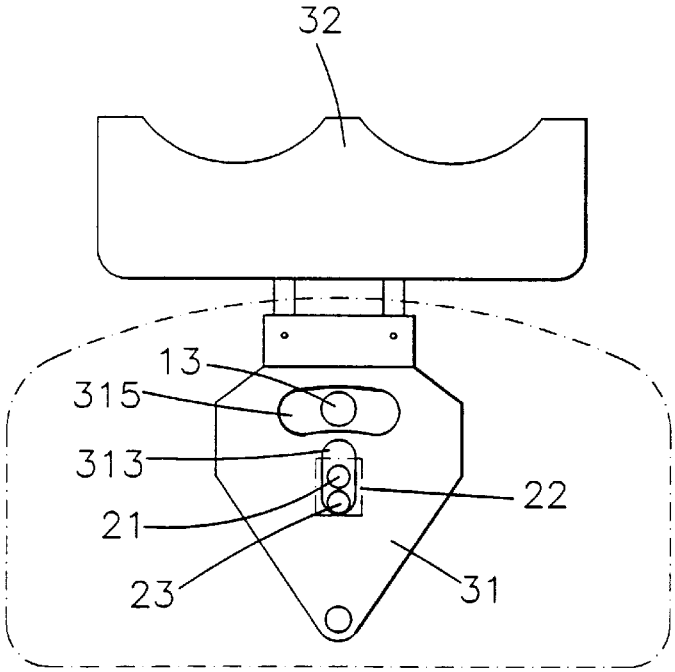

When the rotary block 23 is counterclockwise rotated by 180 degrees as shown in FIG. 8C, the driving shaft 23 of the rotary block 22 is moved to the lowest point of the circular moving path. At this time, the central driven slot 313 is positioned upright and the extension rack 32 of the swinging mechanism 30 is horizontal.

Figure 8D:
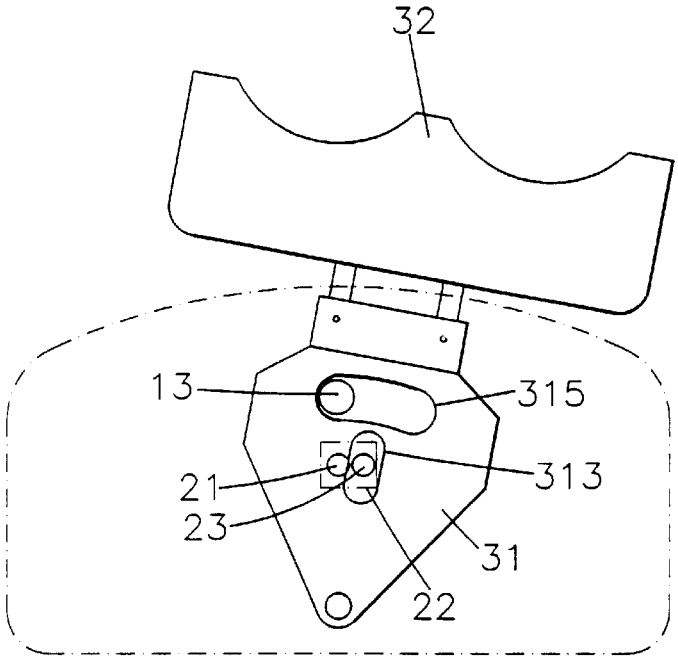

When the rotary block 23 is counterclockwise rotated by 270 degrees as shown in FIG. 8D, the driving shaft 23 of the rotary block 22 is moved to the rightmost point of the circular moving path. At this time, the central driven slot 313 is forced to tilt rightward. That is, the extension rack 32 of the arch swinging mechanism 30 is moved rightward and tilted through an arch path. Accordingly, the right foot of the user is positioned on a level lower than that of the left foot. The right foot is moved downward so that no matter whether the user's body is sitting or lying, the part of the user's body from the lumber bones to the left and right feet can be more smoothly exercised.

In conclusion, the present invention has a unique arch swinging path and not only can horizontally swing and exercise both the left and right feet, but also can intermittently vertically exercise both the left and right feet.

Moreover, the feet are more smoothly moved through an arch path without being pulled outward by a small distance. Therefore, the lumber bones are protected from being injured and the safety in use can be ensured.

In addition, the present invention is swung through an arch path so that the part of the user's body from the lumber bones to the left and right feet can be more smoothly exercised for eliminating the tiredness of the feet and expediting blood circulation of the feet, legs and waist of the user.

The above embodiment is only used to illustrate the present invention, not intended to limit the scope thereof. Many modifications of the above embodiment can be made without departing from the spirit of the present invention.

What is claimed is:

1. Both feet-used arch swinging exerciser comprising:

a housing including a bottom board and a casing defining a receiving space therebetween;

a driving unit fixed on the bottom board and having a rotary output shaft, a rotary block being disposed on the output shaft, a driving rod extending from the rotary block in parallel to the output shaft and being spaced from the output shaft by a predetermined distance; and an arch swinging mechanism including an arch swinging member and an extension rack, the extension rack being positioned outside the housing for both feet of a user to rest thereon, the arch swinging member having a bottom end, a top end and a central driven slot, the bottom end being pivotally connected with the bottom board, the top end being fixedly connected with the extension rack, the driving rod extending into the driven slot and cooperating therewith, so that when the driving rod is operated through a circular path, the arch swinging mechanism and extension rack are reciprocally swung solely through an arch path.

2. Both feet-used arch swinging exerciser as claimed in claim 1, wherein the arch swinging exerciser has a swinging amplitude approximately within 120 degrees, the length of the driven slot being about twice the predetermined distance, the width of the driven slot being about equal to the outer diameter of the driving rod.

3. Both feet-used arch swinging exerciser as claimed in claim 1, wherein an arch guide slot is further formed on the arch swinging member, an auxiliary supporting member being inserted into the arch guide slot for auxiliarily supporting the arch swinging mechanism.

* * * * *